United States Patent [19]

Capo

[11] 4,083,879

[45] Apr. 11, 1978

[54] SEPARABLE CARTON

[75] Inventor: James L. Capo, Franklin, Ohio

[73] Assignee: International Paper Company, New York, N.Y.

[21] Appl. No.: 782,121

[22] Filed: Mar. 22, 1977

[51] Int. Cl.[2] ..... B65D 5/54; B65D 17/24

[52] U.S. Cl. ..... 206/623; 229/38

[58] Field of Search ..... 229/51 DB; 206/45.12, 206/327, 623

[56] References Cited

U.S. PATENT DOCUMENTS

| | | | |
|---|---|---|---|
| 1,772,625 | 8/1930 | Caulfield | 229/51 DB X |
| 2,081,574 | 5/1937 | Bueschel | 229/51 DB X |
| 2,131,391 | 9/1938 | Schraffenberger | 229/51 DB X |
| 3,167,240 | 1/1965 | Collura et al. | 229/51 DB |
| 3,853,259 | 12/1974 | Tupper | 229/51 DB X |

*Primary Examiner*—Davis T. Moorhead
*Attorney, Agent, or Firm*—Richard J. Ancel

[57] ABSTRACT

A carton fabricated from a unitary blank, which is separable into first and second closable units, is provided. The carton comprises first and second main walls, side walls and end closures which define a hollow carton. Means are provided for separating the hollow carton into first and second closable units, each of the units, initially upon separation, having an open end facing the other of the closable units. Means are also provided for closing the open end of each unit when the carton is separated. These closing means comprise a pair of elongated, oppositely disposed closure members and a pair of securing means. Each closure member, which is captured from a main wall of the other of the closable units, comprises a base portion, a shaft portion, and a terminal tongue portion. The base portion of each closure member is non-severably connected to the unit it closes. Each of the securing means in the main wall is positioned to removably secure a tongue portion of one closure member upon closing the open end of each closable unit following separation of the carton.

18 Claims, 7 Drawing Figures

SEPARABLE CARTON

BACKGROUND OF THE INVENTION

This invention relates to merchandising cartons for containing a plurality of individual items. The cartons are constructed from semi-rigid materials, such as paperboard, corrugated board, or the like, and are formed from single, die-cut blanks. They may be readily separated into two detached units when it is desired to separate the contents of the carton. In order to secure the individual articles within each detached unit, each of the units is provided with a closure member that is captured from a main wall of the other unit. While these cartons are particularly adapted for the merchandising of spark plugs, it will be recognized that they are suitable for retaining many other items as well.

Generally, when spark plugs are sold in a retail outlet, each plug is packaged individually in a paperboard carton, and eight such individual packages are housed within a single outer carton. However, it frequently happens that purchasers will desire to purchase less than a package of eight plugs. It is desirable, therefore, to provide an original outer carton of standard size that is capable of being separated into two individual outer cartons, each of which is closable to retain the unused individual packages therewithin for future sale or use. For reasons of economy, it is desirable to manufacture such an outer carton from a single, appropriately cut and scored blank that provides means for closing each of the separated units, wherein such closure means are formed from material captured from the body of the blank. In this manner, the price of such an outer carton can be kept to a minimum because no additional costs are incurred by reason of using additional paperboard material to fabricate such closure means.

Packages that can be broken apart are known in the art. See, for example, U.S. Pat. Nos. 2,046,484 (Ringler); 2,056,032 (Berman); 2,081,574 (Bueschel); 2,359,986 (Grecco); 3,167,240 (Collura et al); and 3,853,259 (Tupper). These references, however, fail to disclose a carton, constructed from a single blank, that is separable into two detached unit, which includes means for closing the open ends of each detached unit adjacent the line of separation, wherein the closure means for each detached unit is captured from a main wall of the other of the detached units.

For example, the patents to Ringler, Berman, and Collura et al merely disclose cartons which can be reduced in size by the removal of portions thereof, with means provided for closing only the open ends of the remaining portions of the cartons. Bueschel discloses a carton for containing eggs or the like, which is separable to form disconnected units, wherein the first disconnected unit includes a transverse partition for closing its open end and a separable, vertically disposed closure member connected to a transverse partition in the second unit for closing its open end adjacent the line of severance. Grecco discloses a divisible carton that may be divided into two equal halves, wherein top end pieces for each half comprise double flaps which, upon separation of the carton, are folded over to close the open ends of each carton half. Tupper discloses a carton which may be separated into two similar body sections, each having closure flaps to close the open ends thereof. The closure member for each section, however, is not captured from a main wall of the other body section.

SUMMARY OF THE INVENTION

The present invention provides an outer carton for containing a plurality of items such as spark plugs, which is separable into first and second detached and closable units. Each of these units includes closure means which are foldable over the open end of the carton, along the line of separation, to thereby close the carton and prevent the loss of individual items. The closure means comprise a pair of elongated, oppositely disposed closure members, each of which is captured from a main wall of the other of the closable units. Each closure member comprises a base portion, a shaft portion, and a terminal tongue portion. The base portion of each closure member is non-severably connected to the detached unit it closes. A pair of securing means are also provided in the main walls, each one being positioned to removably secure the tongue portion of one closure member upon closing the open end of each detached unit following separation of the carton.

The full nature of the invention will be understood from the accompanying drawings and the following description and claims. It should be understood, however, that references in the following description to front, rear and end walls or panels are for convenience of description, and such terms are not intended to be used in a limiting sense.

DETAILED DESCRIPTION OF THE INVENTION

Figure 1:
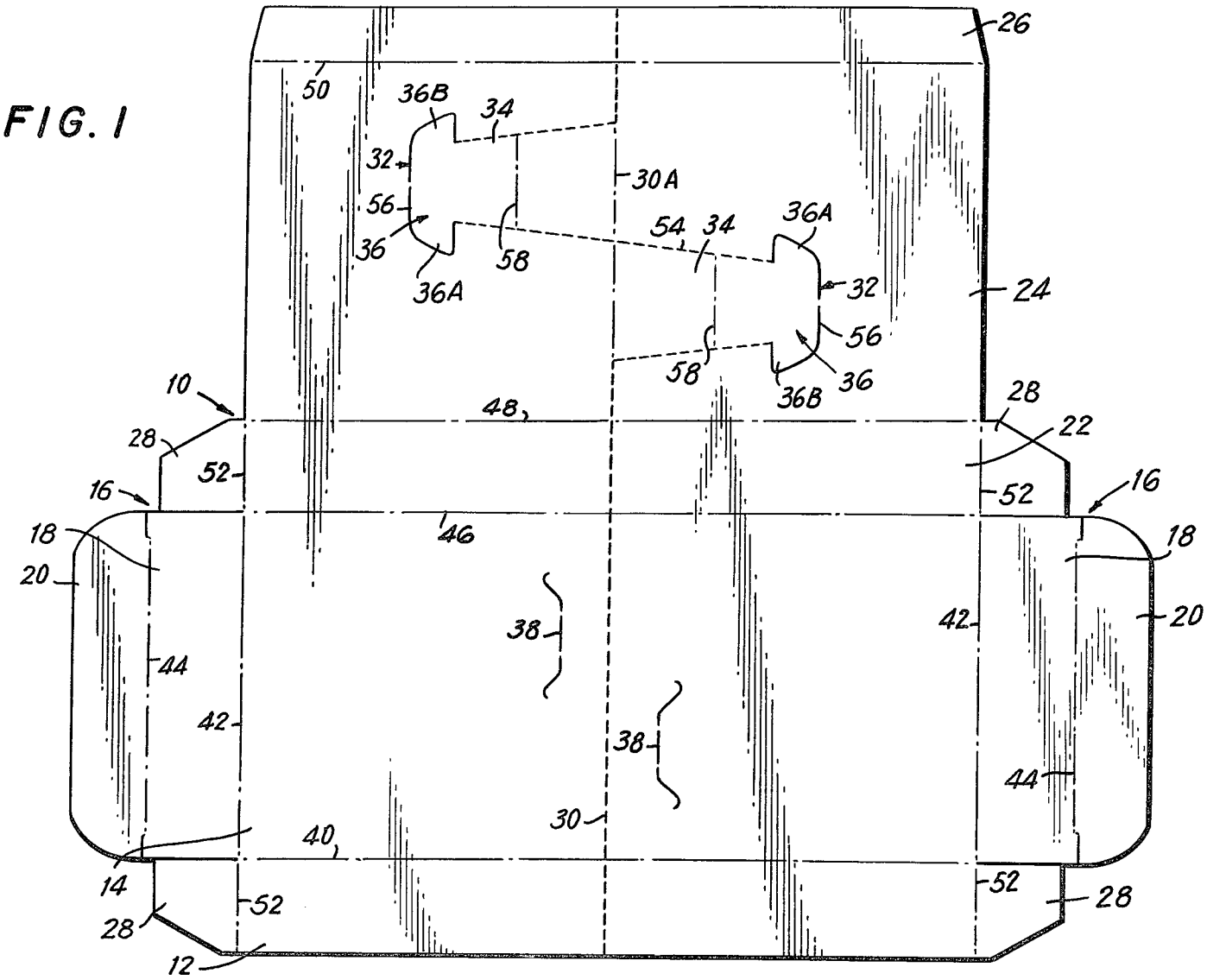
FIG. 1 is a top plan view of a cut and scored blank, which is used to form the carton illustrated in FIGS. 2 – 7.

Reference will first be made to FIG. 1 for a description of the blank employed in forming the carton illustrated in FIGS. 2 – 7. The blank 10 has a generally rectangular overall configuration. It is scored longitudinally along a series of fold lines to provide: a first side panel 12; a main or front panel 14 in side-by-side relation to first side panel 12 and foldably connected thereto along a first longitudinal fold line 40; a second side panel 22 in side-by-side relation to front panel 14 and foldably connected thereto along second longitudinal fold line 46; a main or rear panel 24 in side-by-side relation to second side panel 22 and foldably connected thereto along third longitudinal fold line 48; a glue panel 26 in side-by-side relation to rear panel 24 and foldably connected thereto along fourth longitudinal fold line 50.

Front panel 14 is foldably connected along transverse fold lines 42 to a pair of oppositely disposed end closures 16. Each of the end closures 16 comprises an end panel 18 which is foldably connected along transverse score line 44 to an insert tab or tuck-in flap 20. Cooperating with end closures 16 to close the ends of the unitary carton, are oppositely disposed end flaps 28. As end flap 28 is foldably connected to each end edge of first and second side panels 12, 22, respectively, about transverse fold lines 52.

In order that the carton fabricated from blank 10 may be separated into two units, preferably of equal size, each of which is closable adjacent the line of separation, blank 10 is provided with a transverse, median line of weakness 30, which extends from one edge of the blank to the other. Preferably, weakened line 30 is a combination of a perforated line and a fold line. Specifically, weakened line 30 comprises a first weakened or perforated line of severance along its length except for the area 30A which extends between, but is not in contact with, third and fourth longitudinal fold lines 48, 50 in which it is a fold or score line.

In order to close the open end of each detached unit following fabrication and separation of the carton, a pair of elongated, oppositely disposed closure members 32 are provided. Each of the closure members 32 is captured from rear panel 24 and comprises a base portion abutting transverse, median fold line 30A, an elongated shaft portion 34, and a terminal tongue portion 36. As shown, each of the closure members 32 is defined by transverse, median fold line 30A at its base and a second weakened line of severance extending around the perimeter thereof. This second line of severance comprises severable or perforated lines 54 along the shaft portions 34 of each closure member 32 and cut lines 56 along terminal tongue portions 36 thereof. Preferably, each of the terminal tongue portions 36 is provided with hooklike end portions 36A and 36B. Also provided on each closure member 32 is a transverse fold line 58 about which the closure member is folded when closing the open end of each detached carton following separation. A pair of securing means or slot-forming means 38 are provided in front panel 14. One of the slot-forming means 38 is positioned on each side of transverse, median, weakened line of severance 30 and is positioned to engage tongue portion 36 of the appropriate closure member 32 upon closing the open end of each detached unit following erection of blank 10 into a carton and separation thereof.

Figure 2:
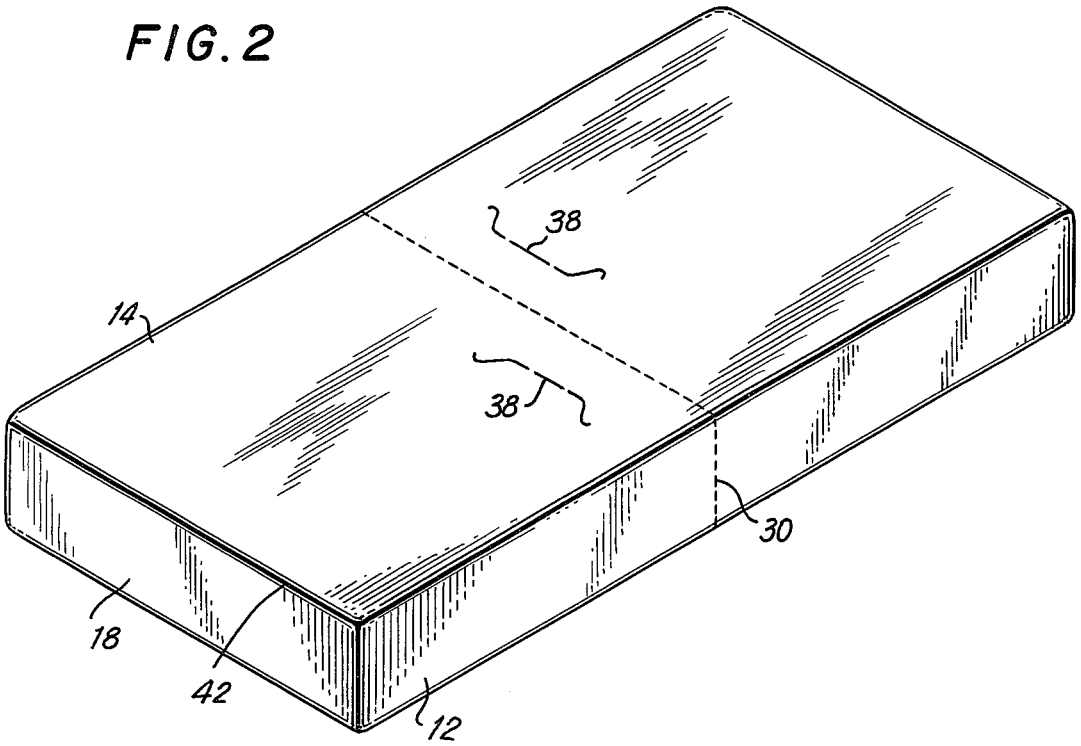
FIG. 2 is a perspective view of the carton in erected condition.
Figure 3:
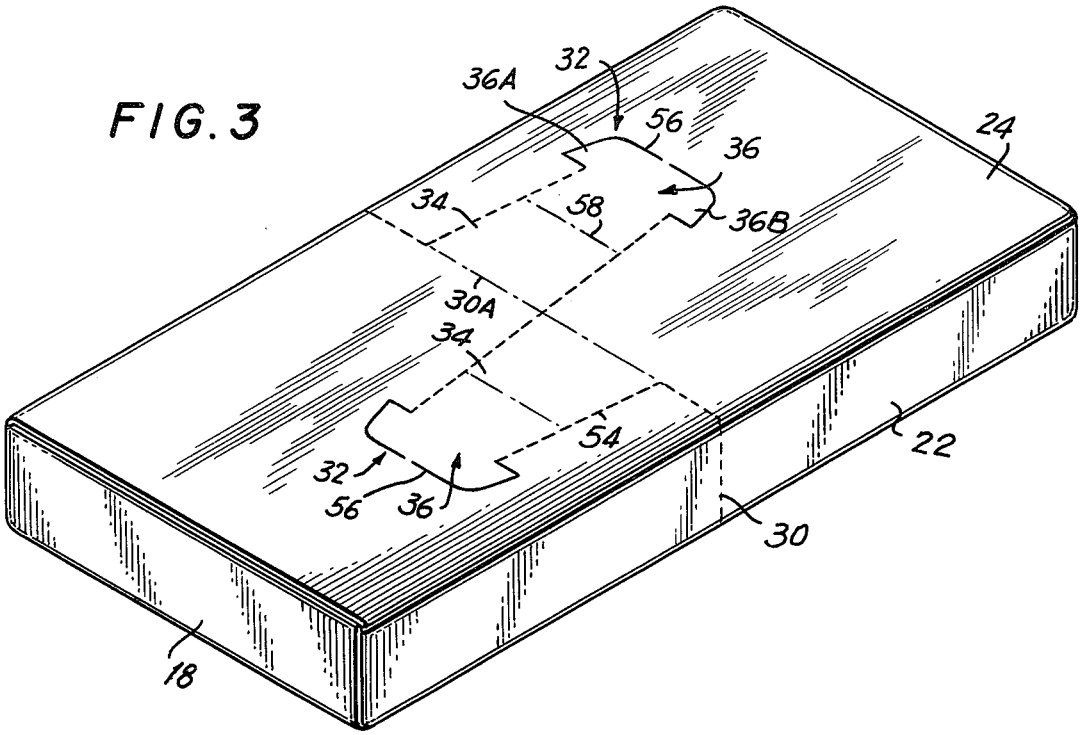
FIG. 3 is a perspective view of the other side of the carton shown in FIG. 2.

The erected and loaded carton illustrated in FIGS. 2 and 3 is formed by taking blank 10 shown in FIG. 1 and bending or folding it about longitudinal score lines 40, 46, 48 and 50 into a rectangular, hollow, open-ended tube. Glue panel 26 is then secured to first side panel 12. In this state, the tube can be collapsed so that it can be shipped or stored in flat condition. The carton may then be readily erected when it is desired to insert the product (not illustrated) therein. When it is desired to close a first end of the carton, end flaps 28 are folded about score lines 52, end closure 16 is folded about score line 42 to overlie flaps 28, and tuck-in flap 20 is folded about score line 44 and inserted into the body of the carton to complete the closure. After the products are inserted into the carton, the other end of the carton is closed in a similar manner.

As shown in FIGS. 2 and 3, the carton fabricated from unitary blank 10 of FIG. 1, which is separable into first and second detached and closable units (shown in FIGS. 4 and 5), comprises first and second main walls 14 and 24, side walls 12, 22 and a pair of end walls 18, which define a hollow carton. For purposes of illustration, main wall 24 can be considered to be a rear wall and main wall 14 can be considered to be a front wall. Rear wall 24 includes a transverse, median fold line 30A extending between, but not in contact with, side walls 12, 22.

The carton includes means for separating it into first and second detached units, each of which, initially upon separation, has an open end facing the other detached unit. These separating means comprise: a first transverse, median, weakened line of severance 30, which connects the outermost ends of transverse, median fold line 30A; and a second weakened line of severance defining a pair of elongated, oppositely disposed closure members 32. The second weakened line of severance begins at one outermost end of transverse, median fold line 30A and extends around the perimeters of each of the closure members 32 and terminates at the opposite end of the transverse, median fold line 30A.

Means are also provided for closing the open end of each of the detached units when the carton is separated. These closing means include a pair of elongated, oppositely disposed closure members 32 and a pair of securing or slot-forming means 38. Each closure member 32 is captured from the rear or main wall 24 of the other of the detached units. Each of the closure members 32 consists of a base portion 30A, a shaft portion 34 and a terminal tongue portion 36. The base portion 30A of each closure member 32 is foldably or non-severably connected to the detached unit it closes along the transverse, median fold line 30A. Each of the slot-forming means 38 is positioned to engage the tongue portion 36 of a closure member 32 when the open end of each detached unit is closed following separation of the carton. One of the slot-forming means 38 is positioned on each side of the transverse, median, weakened line of severance 30.

Figure 4:
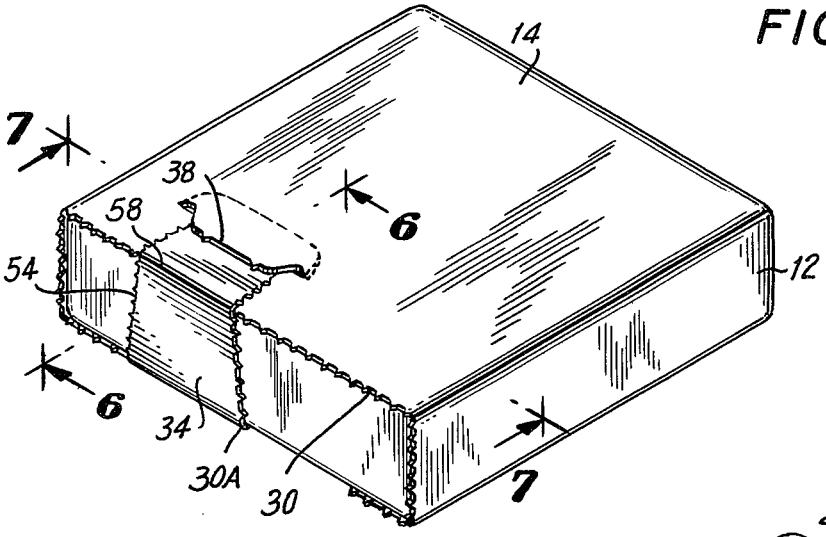
FIG. 4 is a perspective view of one detached unit.
Figure 5:
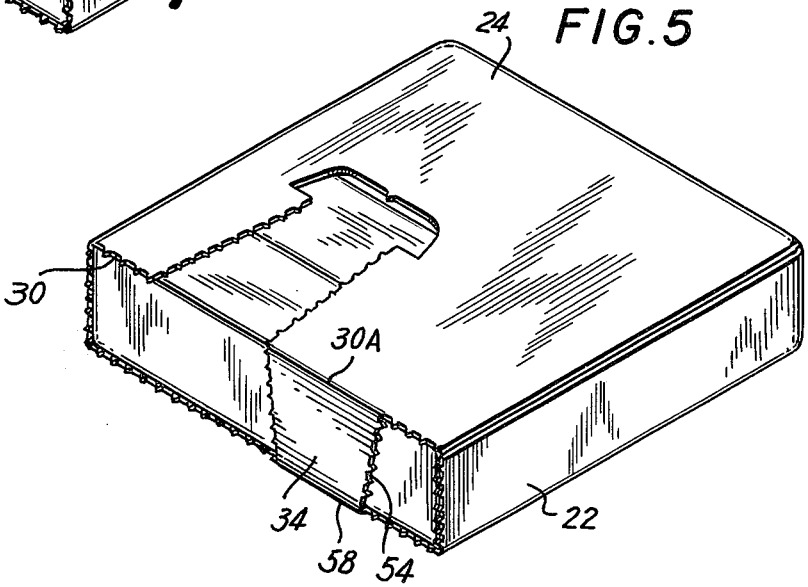
FIG. 5 is a perspective view of the other side of the detached unit illustrated in FIG. 4.

When the separable carton of this invention is in the condition illustrated in FIGS. 2 and 3, it can be broken apart into two individual units in the following manner. The user grasps both ends of the carton with his hands and bends it in opposite directions about transverse, median line of severance 30, thereby separating the carton along line 30 in all areas except along fold line 30A in the rear wall 24 of the carton. The user then separates terminal tongue portions 36 from the surrounding rear wall and similarly separates shaft portions 34 of each closure member along perforated lines 54. The carton then is in the form of two detached units, each having an open end initially facing the other unit. In order to close the open end of each such unit, as best illustrated in FIGS. 4 and 5, each closure member 32 is folded about its base portion 30A and folded once again about transverse fold line 58. Terminal tongue portion 36 is then inserted into slot-forming means 38. Because terminal tongue portion 36 includes hook-like portions 36A and 36B, closure member 32 will not be inadvertently opened, thereby securing the contents within each of the detached units.

Figure 6:
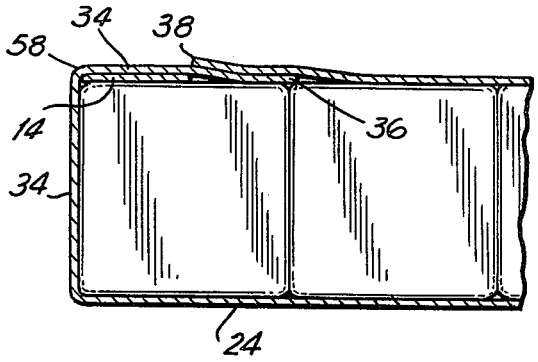
FIG. 6 is a cross-sectional view taken along line 6—6 of FIG. 4.
Figure 7:
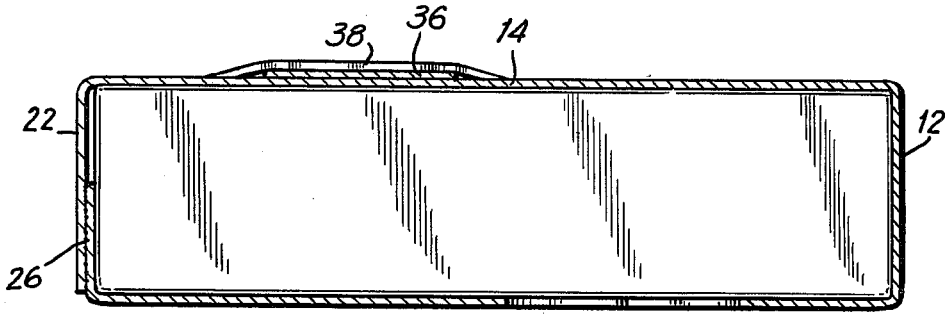
FIG. 7 is a cross-sectional view taken along line 7—7 of FIG. 4.

As shown in FIGS. 6 and 7, shaft portion 34 overlies a portion of front wall 14, and terminal tongue portion 36, which is inserted through slot-forming means 38, is covered by the remaining portion of front wall 14.

Generally speaking, from the foregoing description it will be seen that the present invention consists of a unitary blank and the carton fabricated from the blank, which is separable into first and second detached units. The carton comprises: (a) front, rear and side walls and end closures defining a hollow carton, the rear wall including a transverse, median fold line extending between, but not in contact with, the side walls; (b) means for separating the hollow carton into first and second detached units, each of the units, initially upon separation, having an open end facing the other of the detached units; and (c) means for closing the open end of each of the detached units when the carton is separated, the closing means comprising: (i) a pair of elongated, oppositely disposed closure members, wherein each of the closure members is captured from the rear wall of the other of the detached units, each of the closure members comprising a base portion, a shaft portion, and a terminal tongue portion, wherein the base portion of each closure member is non-severably connected to the detached unit it closes along the transverse, median fold line; and (ii) a pair of securing means in the front wall, each positioned to removably engage the tongue portion of one closure member upon closing the open end of each detached unit following separation of the carton into two, detached units.

Although the invention has been described above by reference to a preferred embodiment, it will be appreciated that other carton constructions may be devised which are, nevertheless, within the scope and spirit of the invention and are defined by the claims appended hereto. For example, it is conceivable that one closure member may be captured from the front wall of one detached unit and the other closure member may be captured from the rear wall of the other, with slot-forming means being appropriately provided.

What is claimed is:

1. A carton fabricated from a unitary blank, which is separable into first and second detached units, said carton comprising:

(a) first and second main walls, side walls and end closures defining a hollow carton, one of said main walls including a transverse, median fold line extending between, but not in contact with, said side walls;

(b) means for separating said hollow carton into first and second detached units, each of said units, initially upon separation, having an open end facing the other of said detached units; and (c) means for closing the open end of each of said detached units when said carton is separated, said closing means comprising:

(i) a pair of elongated, oppositely disposed closure members, wherein each of said closure members is captured from a main wall of the other of said detached units, each of said closure members comprising a base portion, a shaft portion, and a terminal tongue portion, wherein the base portion of each closure member is foldably connected to the detached unit it closes along said transverse, median fold line; and (ii) a pair of securing means in said main walls, each positioned by removably engage the tongue portion of one closure member upon closing the open end of each detached unit following separation of said carton.

2. A carton according to claim 1 wherein said first main wall is a front wall, said second main wall is a rear wall, and wherein the closure member for each detached unit is captured from the rear wall of the other of said detached units.

3. A carton according to claim 1 wherein said means for separating said hollow carton into first and second detached units comprises:

(i) a first transverse, median, weakened line of severance which connects the outermost ends of said transverse, median fold line; and (ii) a second weakened line of severance defining said pair of elongated, oppositely disposed closure members, said second weakened line of severance beginning at one outermost end of said transverse, median fold line, extending around the perimeters of each of said closure members, and terminating at the opposite end of said transverse, median fold line.

4. A carton according to claim 2 wherein each of said closure members is defined by said transverse, median fold line at its base portion, severable lines along its shaft portion, and a cut line along its terminal tongue portion.

5. A carton according to claim 4 wherein said first transverse, median, weakened line of severance comprises a perforated line.

6. A carton according to claim 2 in which each of said end closures comprises:

(a) an end wall foldably connected to each end edge of said front wall about transverse fold lines;

(b) a tuck-in flap foldably connected to each of said end walls about transverse fold lines; and (c) a pair of oppositely disposed end flaps foldably connected to each of said side walls about transverse fold lines.

7. A carton according to claim 2 wherein said first and second detached units are of equal dimension.

8. A carton according to claim 2 which is constructed of paperboard.

9. A carton according to claim 2 wherein said securing means comprise slot-forming means.

10. A carton fabricated from a unitary blank, which is separable into first and second detached units, said carton comprising:

(a) front, rear and side walls and end closures defining a hollow carton, said rear wall including a transverse, median fold line extending between, but not in contact with, said side walls;

(b) means for separating said hollow carton into first and second detached units, each of said units, initially upon separation, having an open end facing the other of said detached units, said separating means comprising:

(i) a first transverse, median, weakened line of severance which connects the outermost ends of said transverse, median fold line; and (ii) a second weakened line of severance defining a pair of elongated, oppositely disposed closure members, said second weakened line of severance beginning at one outermost end of said transverse, median fold line, extending around the perimeters of each of said closure members, and terminating at the opposite end of said transverse, median fold line; and (c) means for closing the open end of each of said detached units when said carton is separated; said closing means comprising:

(i) said pair of elongated, oppositely disposed closure members, wherein each closure member is captured from the rear wall of the other of said detached units, each of said closure members comprising a base portion, a shaft portion, and a terminal tongue portion, the base portion of each closure member being foldably connected to the detached unit it closes along said transverse, median fold line; and (ii) a pair of slot-forming means in said front wall positioned to removably engage the tongue portion of one closure member when the open end of each detached unit is closed upon separation of said carton, one of said slot-forming means being positioned on each side of said first transverse, median, weakened line of severance.

11. A carton according to claim 10 wherein each of said closure members is defined by said transverse, median fold line at its base portion, severable lines along its shaft portion, and a cut line along its terminal tongue portion.

12. A carton according to claim 10 wherein said first transverse, median, weakened line of severance comprises a perforated line.

13. A carton according to claim 10 in which each of said end closures comprises:

(a) an end wall foldably connected to each end edge of said front wall about transverse fold lines;

(b) a tuck-in flap foldably connected to each of said end walls about transverse fold lines; and (c) a pair of oppositely disposed end flaps foldably connected to each of said side walls about transverse fold lines.

14. A carton according to claim 10 wherein said first and second closable units are of equal dimension.

15. A carton according to claim 10 which is constructed of paperboard.

16. A unitary blank for fabricating a carton that is separable into first and second detached units, said blank comprising:

(a) a first rectangular side panel at one edge of the blank;

(b) a front panel in side-by-side relation to said first side panel and foldably connected thereto along a first longitudinal fold line, said front panel foldably connected, along transverse fold lines, to a pair of oppositely disposed end closures, each of said end closures comprising an end panel which is foldably connected along a transverse fold line to an insert tab;

(c) a second side panel in side-by-side relation to said front panel and foldably connected thereto along a second longitudinal fold line;

(d) a rear panel in side-by-side relation to said second side panel and foldably connected thereto along a third longitudinal fold line;

(e) a glue panel in side-by-side relation to said rear panel and foldably connected thereto along a fourth longitudinal fold line;

(f) a pair of oppositely disposed end flaps foldably connected to each of said first and second side panels about transverse fold lines;

(g) a transverse, median line of weakness extending from one edge of said blank to the other, said transverse, median line of weakness comprising:

(i) a fold line extending between, but not in contact with, said third and fourth longitudinal fold lines; and (ii) a line of severance along the remaining portions thereof;

(h) a pair of elongated, oppositely disposed closure members, each of said closure members being captured from said rear panel and comprising a base portion abutting said transverse, median fold line, an elongated shaft portion and a terminal tongue portion, each of said closure members being defined by said transverse, median fold line at its base portion, severable lines along its shaft portion and a cut line along its terminal tongue portion;

(i) a pair of slot-forming means in said front panel, one of said slot-forming means being positioned on each side of said transverse, median, weakened line of severance and each being positioned to engage the tongue portion of one closure member upon closing the open end of each detached unit following erection of said blank into a carton and separation thereof.

17. A blank according to claim 16 which is constructed of paperboard.

18. A blank according to claim 16 which is constructed of corrugated board.

* * * * *